United States Patent [19]

Schwarz et al.

[11] Patent Number: 4,608,328

[45] **Date of Patent: * Aug. 26, 1986**

[54] DONOR FOR TOUCHDOWN DEVELOPMENT

[75] Inventors: William M. Schwarz, Webster, N.Y.; John M. Pochan, Racine, Wis.

[73] Assignee: Xerox Corporation, Stamford, Conn.

[ * ] Notice: The portion of the term of this patent subsequent to Dec. 3, 2002 has been disclaimed.

[21] Appl. No.: 729,790

[22] Filed: May 2, 1985

[51] Int. Cl.[4] ..... G03G 13/08; G03G 15/08

[52] U.S. Cl. ..... 430/101; 430/102; 430/120; 118/624; 118/650; 118/653; 361/225; 361/226

[58] Field of Search ..... 430/101, 102, 120; 118/624, 650, 653; 361/225, 226

[56] References Cited

U.S. PATENT DOCUMENTS

| | | | |
|---|---|---|---|
| 2,217,776 | 11/1940 | Carlson . | |
| 2,576,047 | 11/1951 | Schaffert | 101/246 |
| 2,874,063 | 2/1959 | Greig . | |
| 3,166,432 | 1/1965 | Gundlach . | |
| 3,203,394 | 8/1965 | Hope et al. . | |
| 3,251,706 | 5/1966 | Walkup . | |
| 3,357,402 | 12/1967 | Bhagat . | |
| 3,470,009 | 9/1969 | Gundlach . | |
| 3,590,000 | 6/1971 | Palermiti et al. . | |
| 3,618,552 | 11/1971 | Grihangme | 114/67 A |
| 3,720,617 | 3/1973 | Chatterji et al. . | |
| 3,739,748 | 6/1973 | Rittler et al. . | |
| 3,799,113 | 3/1974 | Whited . | |
| 3,998,185 | 12/1976 | Weiler | 118/651 |
| 4,011,834 | 3/1977 | Stephan | 118/653 |
| 4,144,061 | 3/1979 | Bean . | |
| 4,149,486 | 4/1979 | Hardenbrook | 118/653 |
| 4,355,167 | 10/1982 | Ciccarelli | 546/255 |
| 4,459,009 | 7/1984 | Hays et al. | 355/3 DD |
| 4,556,013 | 12/1985 | Gundlach et al. | 118/624 |

*Primary Examiner*—Roland E. Martin

[57] ABSTRACT

An electrostatographic method and apparatus for developing an electrostatic latent image on an imaging surface, comprises a charging doner member which is preferably a rotatably mounted roll closely spaced from the imaging surface at one portion and having a housing means to be filled with toner positioned adjacent the doner member at another portion together with a web screen located in the housing and adapted to contact the donor member on the portion of its surface opposite the imaging member; the donor member having a surface comprising an active polymer having a basic amine moiety whereby when the donor roll is rotated the rubbing contact between the toner, the screen means and the donor member produces negatively charged toner particles. In a preferred embodiment the active polymer having a basic amine moiety is selected from poly(2-vinylpyridine), poly(4-vinylpyridine), polyvinylpyrolidone, poly (dimethyl aminoethyl methacrylate) and the toner includes a minor amount of fumed silica additive.

18 Claims, 4 Drawing Figures

DONOR FOR TOUCHDOWN DEVELOPMENT

CROSS-REFERENCE TO RELATED APPLICATION

Attention is hereby directed to U.S. patent application Ser. No. 549,096 entitled "Screen Donor For Touchdown Developement" filed in the names of Robert W. Gundlach, William M. Schwarz, Jr. and Kenneth W. Guenther filed Nov. 7, 1983 commonly assigned to the Assignee of the present invention.

BACKGROUND OF THE INVENTION

The present invention relates generally to electrostatographic reproducing apparatus and in particular to a developing apparatus and methods for use in such a machine. More particularly, the present invention is directed to an improved screen donor member and method of using same in touchdown development.

Generally in the process of electrostatographic printing a photoconductive insulating member is charged to a substantially uniform potential to sensitize the surface thereof. The charged portion of the photoconductive insulating layer is thereafter exposed to a light image of an original document to be reproduced. This records an electrostatic latent image on the photoconductive member corresponding to the informational areas contained within the original document. After recording the electrostatic latent image on the photoconductive member, the latent image is developed by bringing a developer material charged of an opposite polarity into contact therewith. Toner particles are attracted to the electrostatic latent image to form a toner powder image which is subsequently transferred to a copy sheet and thereafter permenantly affixed to the copy sheet by fusing thereto.

The development of the electrostatic latent images may be carried out in a variety of ways. Development systems well known and developed in the prior art include those described in U.S. Pat. No. 3,618,552 Cascade Development; U.S. Pat. Nos. 2,874,063, and 3,251,706 and 3,357,402 Magnetic Brush Development; U.S. Pat. No. 2,217,776 Powder Cloud Development and U.S. Pat. No. 3,166,432 Touchdown Development.

Transfer development broadly involves bringing a layer of toner to an imaged photoconductive insulating layer where toner particles will be transferred from the layer to the imaged areas. In one touchdown development technique, a layer of charged toner particles is applied to a donor member which is capable of retaining the particles on its surface and then the donor member is brought into close proximity to the surface of the photoconductor. In the closely spaced position particles of toner in the toner layer on the donor member are attracted to the photoconductor by the electrostatic charge on the photoconductor opposite to the toner charge so that development takes place. In this technique the toner particles must traverse an air gap to reach imaged regions of the photoconductor. In the other touchdown development techniques the toner laden donor actually contacts the imaged photoreceptor and no gap is involved. In one such technique the toner laden doner is rolled in non-slip relationship into and out of contact with the electrostatic latent image to develop the image in a single rapid step. In another such technique the toner laden donor is skidded across the xerographic surface. Skidding the toner by as much as the width of a thin line will double the amount of toner available for development of the line if it lies perpendicular to the skid direction. The amount of skidding can be increased to achieve greater density or greater area coverage.

In a typical transfer development system, a cylindrical or endless donor member is rotated so that its surface can be presented to the moving surface of a photoconductive drum bearing an electrostatic latent image thereon. Positioned about the periphery of the donor member are a number of processing stations including, a donor loading station, at which toner is presented to and coated on the donor member surface; an agglomerate removal station at which toner agglomerates and excess toner are removed from the toner layer retained on the surface of the donor member; a charging station at which a uniform charge is placed on the particles of toner retained on the donor surface; a clean up station at which the toner layer is converted into one of uniform thickness and uniform charge state at which any toner agglomerates not removed by the agglomerate removal station are removed; a development station at which toner particles carried by said donor member are presented to the imaged photoconductor for image development; and a cleaning station at which a neutralizing charge is placed upon the residual toner particles and at which a cleaning member removes residual toner from the peripheral surface of the photoreceptor. In this manner, a continuous development process is carried out.

Among the donor members employed in the prior art are those embodying the principles described in U.S. Pat. No., 3,203,394. Such a donor includes, an electrically conductive support member in the form of a cylinder, a thin electrically insulating layer overlying a support member, and a continuous, electrically conductive screen pattern is provided with an electrical connection to a slip ring so that its potential may be varied between ground potential and a charge potential at different stages of process. A multitude of high fringe fields or microfields are created at the surface of this type of donor member. When this type of donor member is brought into contact with toner particles it is loaded with toner.

A donor member of this type is quite expensive to manufacture, it is quite fragile in the screen regions and is subject to being electrically disabled, e.g., through shorting of the screen to the conductive substrate, unless considerble care is taken during its manufacture and use.

Recently a touchdown development technique which is simplier, has a more reliable donor member and more cost effective has been developed. In the cross referenced copending application, a touchdown development technique is provided for loading a donor member in a simple, uncomplicated process which includes inserting an open mesh screen in a toner loading hopper and directly contacting the toner member in the toner loading zone. The screen serves to friction charge the toner after it passes through the open mesh and rubs against the donor member thereby forming a dense, uniform layer of toner on the surface of the donor member. This system has the advantages of minimizing airborne dust, simplicity, elimination of toner concentration problems, and provides excellent solid area coverage. The donor member described in said copending application Ser. No. 549,096 employed an anodized aluminum roll which initially worked very well in charging toner particles but with continued use on ageing experienced a marked reduction in its capability to charge the toner effectively and efficiently. Furthermore in operating at a relatively high humidity level, the charge level produced on the toner was substantially reduced, frequently reaching levels where unacceptable development could be obtained. In addition the anodized aluminum donor member is hard and since this must run in contact with a photoreceptor surface, the opportunity and frequency of damage to the photoreceptor surface by coming into contact therewith is dramatically increased.

PRIOR ART

U.S. Pat. No. 4,459,009 (Hays et al) discloses an apparatus and process for charging toner particles wherein a charging roll containing a triboelectrically active coating moves in a direction opposite the direction of movement of the toner transporting device and is spaced therefrom by the toner particles with both the charging means and the transporting means being biased to predetermined potentials to charge the toner particles. An electropositive triboelectrically active coating may include polyvinylpyridines, terpolymers of methacrylates and thermoplastic toner resins.

U.S. Pat. No. 4,355,167 (Ciccarelli) describes charge control agents wherein positively charged toner materials are desired comprising telomeric quaternary salts, a portion of which may include 2-vinylpyridine, 4-vinylpyridine, or dimethylaminoethylmethacrylate (column 3, lines 20–31).

SUMMARY OF THE INVENTION

In accordance with the present invention an electrostatographic development apparatus and method for developing an electrostatic latent image present on an imaging surface are provided.

The apparatus comprises a charging donor member preferably in the form of rotatably mounted cylindrical donor roll which is closely spaced from an imaging surface around the portion of its periphery and adapted to apply toner to the imaging surface. The apparatus is provided with housing means adapted to be filled with toner positioned adjacent to the donor member for loading toner onto the donor member for electrostatic transfer to the imaging surface during development. A webbed screen means is located in the housing means and adapted to contact the donor member so that the toner loaded from the housing means onto the donor member passes through the webbed screen means in order to make rubbing contact with and form a dense uniform layer on the donor member. The donor member has a surface comprising an active polymer having a basic amine moiety wherein the rubbing contact between the toner, the screen means and the donor member produces negatively charged toner particles.

In a specific aspect of the present invention the active polymer having a basic amine moiety is selected from poly(2-vinylpyridine), poly(4-vinylpyridine), polyvinylpyrollidone, poly(dimethylaminoethyl methacrylate).

In a further aspect of the present invention, the active polymer is copolymerized with a material selected from styrene, acrylates and butadiene with the active polymer being present in an amount greater than about 30% by weight of the copolymer.

In a further aspect of the present invention, the copolymer is blended with materials selected from styrene, acrylates and butadiene and mixtures thereof with the preferred mixture comprising a styrene butadiene latex.

In a further aspect of the present invention, the charging operation provides charge on the toner particles of from about 10 to 20 microcoulombs per gram or more.

In a further aspect of the present invention the toner particles include a minor amount of a submicroscopic silicon dioxide additive particle.

In a further aspect of the present invention to provide a developing method and apparatus are provided capable of consistently producing over a period of time negatively charged toner particles having adequate charge associated therewith to accomplish acceptable development of an electrostatic latent image when brought in contact therewith.

An additional aspect of the present invention is to provide an improved, simple, relatively inexpensive development apparatus for an electrostatographic reproducing machine.

In a further aspect of the present invention a development apparatus and method provide relatively high charge rate and charge level with toner particles to be used in developing electrostatic latent image.

An additional aspect of the present invention is to provide a compliant toner donor roll for use in a C-shell development apparatus.

A further aspect of the present invention is to reduce if not eliminate the wearing abrasion between the donor roll and the photoreceptor surface with which it is in contact during the development operation.

DESCRIPTION OF THE PREFERRED EMBODIMENT

The invention will now be described with reference to the preferred embodiment of an electrostatographic reproducing machine according to the present invention.

Figure 1:
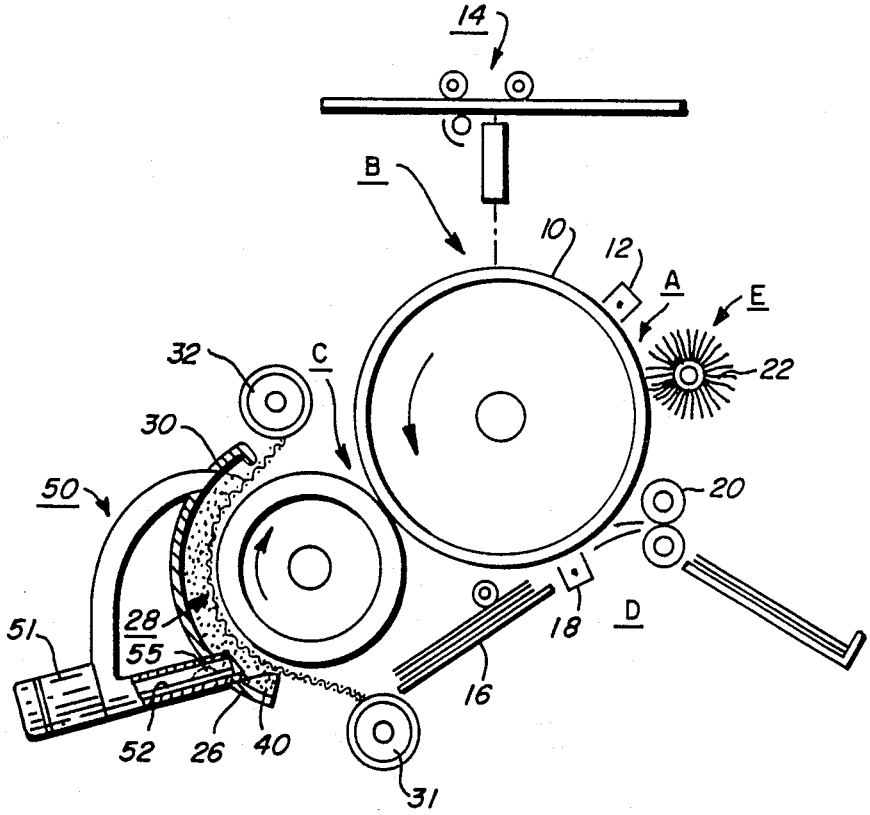
FIG. 1 is a schematic representation in cross section of portions of an electrostatic reproducing machine employing the method and apparatus of the present invention.

Referring to FIG. 1, there is shown a xerographic reproduction system utilizing the concept of the present invention. In this apparatus a xerographic plate is in the form of a drum 10 which passes through stations A–E in the direction shown by the arrow. The drum has a suitable photosensitive surface, such as one including selenium overlying a layer of conductive material, on which a latent electrostatic image can be formed. The various stations about the periphery of the drum which carry out the reproduction process are: charging station A, exposing station B, developing station C, transfer station D, and cleaning station E. Stations A, B, D, and E represent a conventional means for carrying out their respective functions. Apart from their association with the novel arrangement to be described with respect to station C they form no part of the present invention.

At station A, a suitable charging means 12, e.g., a corotron, places a uniform electrostatic charge on the photoconductive material. As the drum rotates, a light pattern, via a suitable exposing apparatus 14, e.g., a projector, is exposed onto the charged surface of drum 10. The latent image thereby formed on the surface of the drum is developed or made visible by the application of a finely divided pigmented, resinous powder called toner at developing station C, which is described in greater detail below. After the drum is developed at station C, it passes through transfer station D, comprising copy sheet 16, corona charging device 18 and fuser device 20. Following transfer and fixing of the developed image to the copy sheet, the drum rotates through cleaning station E, comprising cleaning device 22, e.g., a rotating brush.

At developing station C, the apparatus includes a donor member 24 rotatably mounted adjacent a toner housing or reservoir 26 containing a supply of toner 28. The donor member or roll 24 is positioned so that a portion of its periphery comes into contact with toner 28. The donor roll is also located so as to contact the surface of drum 10 to present the outer surface of a toner layer carried by donor roll 24 to the drum.

Figure 2:
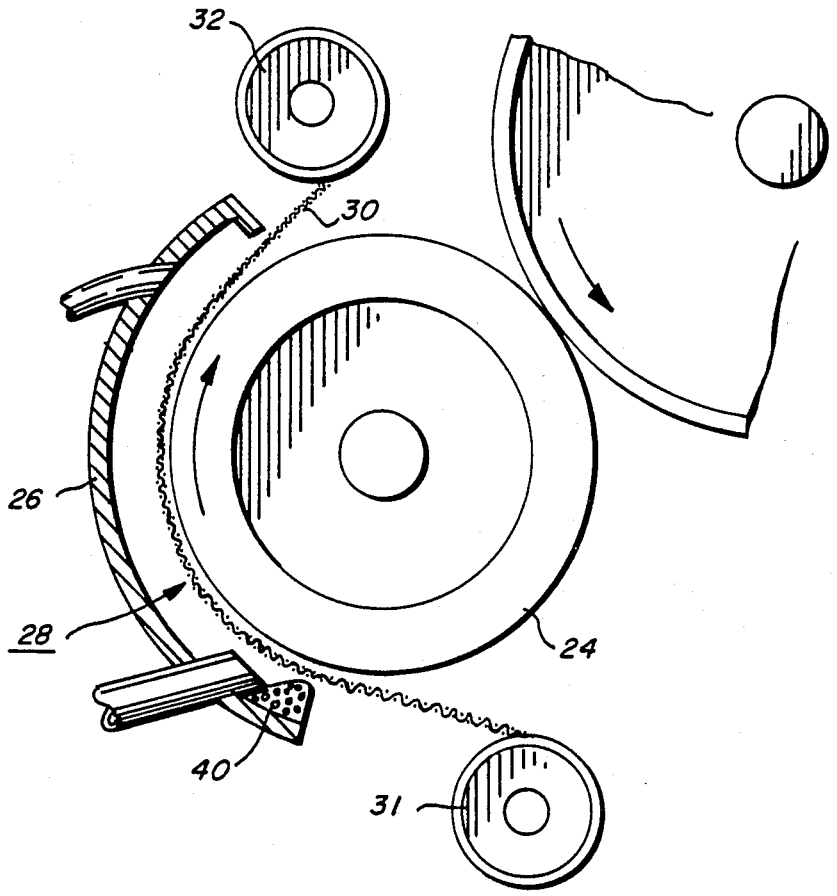
FIG. 2 is an enlarged cross section of the donor development apparatus as shown in FIG. 1.

Referring now to FIG. 2 of the drawing, there is shown a development system of the type contemplated by the present invention. Donor member 24, is positioned so that a portion of its periphery may be rotated into contact with a mass of toner particles 28 in a toner housing or reservoir 26. Located between the toner housing 26 and the donor member 24 is a webbed screen means 30 which is shown rotatably mounted on a supply roll 31 and a take-up roll 32. The screen extends from a position outside the housing 26 into and out of the housing with a portion of its surface in contact with the donor member 24. Preferably, the screen serves three separate functions and in the embodiment illustrated consist of three different segments. First, the lower portion is a coarser mesh to allow toner to flow into contact with the donor more readily. The next section is less coarse and provides the major portion of rubbing action to the toner particles as they pass through the screen toward the donor member surface for tribo charging the toner and the donor member and could have a pad of foam elastomer behind it or other means to provide extra pressure. Then the uppermost segment, being the least coarse, will remove and return excess toner to the sump 28 and gently and uniformly smooth out the charged toner coating to a streak-free uniform layer. Housing 26 is enclosed at one end against screen 30 by seal 40. In order to help toner flow through the screen, a suitable means such as a paddle or auger assembly 50 applies pressure to toner in sump 28 to insure passage of the toner through screen 30 in amounts sufficient to coat donor member 24. A motor 51 through shaft 52 turns auger member 55 to propel toner through the screen. Further, it should be understood that the triple segmented screen could be replaced by a screen with a uniform mesh, if desired that would be unwound from supply roll 31 periodically to present a new friction surface to the toner and donor member. When a new friction surface is desired with the triple segmented screen in use, the supply roll and take-up roll are energized long enough to present a totally new three sectioned screen portion to the toner and donor member.

By just filling toner housing 26 with one component toner to about the 9 o'clock level, very little toner will adhere to the donor member since its charge will be much too low. However, by inserting an open mesh screen, e.g., woven or knit Nylon, Dacron polyester, or porus foam or the like against the donor surface and keeping it stationary against the rotating donor cylinder, a surprisingly dense and uniform layer of well charged toner is formed on the donor member. It is important that the toner and donor materials be selected for tribo charging. It is also important that the screen leaves contact with the donor member at a tangent point well above the top of the toner bath so that any excess toner will be removed from the screen due to gravity and settle back into housing 26. As shown in FIG. 2, the screen has a tangent point in relation to the surface of donor member 24 above 270° and below 360° to accomplish this non-overloading requirement in this embodiment.

In operation, as donor member 24 rotates in the direction shown by the arrow in FIG. 1, at approximately the 180° position the donor member begins taking on toner from a "C-shell" configured developer housing 26 through screen 30 that is now stationarily positioned in friction contact with the outer surface of the donor member from about the 180° position to about the 280° position. Toner passing through the screen is friction charged and adhers to the donor surface. Continued rotation of the donor member brings the toner now loaded onto its outer surface into contact with an oppositely charged latent image on photosensitive member 10 whereby toner is transferred from the donor member to latent image on the photosensitive member for subsequent transfer to copy paper 16 by the use of transfer corotron 18.

As will be appreciated from the foregoing description in the C-shell donor roll development system, the donor roll is running in contact with and at the same speed as the photoconductive drum. Therefore in each revolution of the donor roll, the toner must be recharged to be capable of development in a development process. In other words, after the developer roll leaves the development zone there are areas on the developer roll where no toner remains. These areas must be retoned in the next pass through loading zone to be capable of development subsequently in the development zone. Accordingly with C-shell development there is a need for relatively high charge rate and a high charge level on the toner to be adequate for development. We have found typically the charge level to be in the range of 10 to 20 microcoulombs per gram and the charge rate to be adequate to retone the roll on each pass.

We have also found that if the donor member has a surface comprising an active polymer having a basic amine moiety that enhanced charging of the toner will be achieved. While not wishing to be bound to any theory of operation, it is believed that when the donor member surface comprises an active polymer having a basic amine moiety that this material donates charge to the toner, thereby enhancing the charge on the toner. By the term active polymer is meant a polymeric material which will triboelectrically charge toner. By the term basic amine moiety we intend to define a chemical species or group such as primary, secondary and tertiary amines, amides and similar structures which will accept a proton from a donor species. The amount of active polymer having a basic amine moiety present in the donor member surface although not critical should be effective to enhance the negative charging of the individual toner particles. As the amount of active polymer having a basic amine moiety increases in the donor surface the faster the toner particles will be charged and to a higher charge level. Generally adequate charging level and charge rate are achieved with as little as 10% by weight of the active polymer being present in the donor member surface although a minimum of 30% by weight is preferred.

Preferred materials include among others poly(2-vinylpyridine), poly(4-vinylpyridine), polyvinylpyrollidone, poly(dimethylaminoethylmethacrylate). These materials may be used alone as a donor member surface or preferably may be blended with another polymer or copolymer forming a physical mixture therewith to improve their mechanical properties. Typical of the materials that it may be blended with include polystyrene, butadiene, acrylates, silicon rubbers, and urethanes. In addition, the active polymers having a basic amine moiety may be copolymerized with styrene, butadiene and acrylates forming active copolymers to also improve their mechanical properties. A copolymer of 70 parts by weight 2 vinylpyridine and 30 parts by weight styrene is a particularly preferred material and when blended with 10% by weight Ketjenblack and spray coated onto conductive rubber rolls provides a rapid, high level charging, long life roll. Furthermore terpolymers including one of the active ingredients listed above together with styrene and butadiene may be employed. Typical of such materials are terpolymers including 2-vinylpyridine, styrene and butadiene. A terpolymer of styrene, N-butylmethacrylate and dimethylaminoethyl methacrylate (DMAEMA) in weight ratio of 65/1.3/33.7% is an example of such a material and when blended with 10% by weight Ketjenblack and spray coated onto conductive rubber rolls provides a rapid, high level charging long life roll. In addition the above mentioned preferred copolymer and terpolymer have high weight ratios of active component and form strong films that resist cracking.

When used as a charging donor member in a cyclic mode where the surface is used to charge toner in each pass it is preferred to provide a finely divided conductive filler in a material from which the donor member is made to provide a discharge path to remove or leak away any residual surface charge on the donor member from the preceeding cycle. This is because during the charging of the toner, a counter charge is generated on the donor member surface which must be removed before the next charging cycle otherwise there will be buildup of counter charge which will inhibit triboelectric charging of the toner in subsequent passes. The conductive fillers which are present in amounts sufficient to provide this rapid cyclic discharge are typically present in amounts of about 10% by weight of the donor member material. Carbon blacks such as Ketjenblack available from Noury Chemical Corporation, Burt, N.Y., are particularly effective for this purpose.

Typically, the donor members are formed into elongated cylindrical rolls wherein the surface comprises an active polymer layer having the noted basic amine moiety. They may be fabricated in any suitable technique. Typical of those which have proved successful in the past include spray coating the polymers in a methylethyl ketone solution onto a substrate such as a conductive rubber roll about 1 inch in diameter. The thickness of the active surface is not critical as long as it provides sufficient charging surface. Subsequently the sprayed rolls may be air or oven dried or dried in a vacuum at a temperature of about 80° C. In addition to spray coating solutions of the polymers onto a substrate the polymers themselves may be directly molded into elongated cylindrical members. With all the donor rolls surfaces described above it should be noted that a compliant soft donor roll is provided which may be driven by friction contact with a photoreceptor member without abrading or otherwise mechanically destroying or interferring with the surface of the photoconductive member. This permits the desired soft donor roll, hard photoreceptor interface wherein the photoreceptor is not mechanically degraded.

Any suitable toner may be used with donor member. Typical toner materials include colored toner resins such as for example, vinyl resins, acrylic resins, polyesters, and epoxies containing pigments and/or dye colorants such as for example, carbon black, phthalocyanine blue or chrome yellow and optionally other small amounts of well known agents such as charge enhancing agents. Typically, the colorant is present in an amount of from about 3% to 20% by weight of the resin.

It has also been found that an enhancement of the charge level in the toner may be provided if the toner contains a minor amount of a submicroscopic fumed silica additive in the toner material. Typically the silica particles have a portion of the silicon atoms on the outside surface attached through an oxygen atom to another silicon atom which is attached through a carbon linkage to organic groups. The silica particles are typically submicron in diameter and are present in an amount of about 0.05 to 1.5% by weight of the toner material. In this connection attention is directed to U.S. Pat. No. 3,720,617 (Chatterji et al) which describes in detail the use of such an additive to toner material in order to obtain stability in developer performance. The presence of such a silica additive in the toner is believed to provide distinct hydrogen ion transfer from the silica additive to the active amine moiety on the donor member thereby enhancing the negative charge on the toner particles. While the presence of a small amount of the silica exhibits this effect with a wide variety of toner materials it has a particularly pronounced effect for those colored toners comprising a resin which is the polymeric esterification product of a dicarboxylic acid and a diol comprising a diphenol with or without having added thereto a small amount of a solid stable hydrophobic metal salt of a fatty acid on the surface of the particles. For further details of such a toner material attention is directed to U.S. Pat. No. 3,590,000 (Palermiti et al).

EXAMPLES

The following examples illustrate preferred embodiments of the present invention. In all the examples the toner comprises a colored resin which is the esterification product of a dicarboxylic acid and a diol comprising a diphenol but without the metal salt as described in the above mentioned Palermiti et al. patent, and containing 1% of Aerosil R972 (available from DeGussa Corp.) as an additive. In the table below, examples 7 and 9 are presented for comparison purposes only. Unless otherwise specified all percentages are by weight in all the examples which follow. In Examples 1–9, The toner charge level and toner charge rate were obtained through a simulation in a charging test fixture based on a drill press. A flat plate similar to a sanding disc was attached to the drill chuck. Mounted on the plate extending radially from the center was a small foam pad covered with soft polyester fabric. This construction provides a rotatable charging pad. The sample charging polymers were coated onto a flat stationary conductive metal substrate, and mounted on a force loading platform under the charging disc. Typically, charging measurements were carried out by placing a radial stripe of toner (approximately 0.3 g) on a 6'×6' coated sample substrate, supplying a total force of 300 g between sample substrate and charging pad; rotating the pad disc 3 revolutions at 20 RPM. Full equilibrium was obtained under such conditions. If the toner charged adequately it deposited on the substrate plate immediately with very little pressure to give a dense, uniform toner deposit. If it did not charge rapidly, the toner would be pushed ahead of the pad with little or no deposition.

The toner deposit charge was measured by attaching the metal substrate plate coated over a known area with charged deposited toner to a high sensitivity electrometer and measuring the total charge flow from the plate through the electrometer which occurs when the toner deposit is blown from the substrate plate with a high viscosity air stream. The deopsit mass determined by simply weighing the substrate plate before and after toner blow off. All charge, mass and charge to mass ratios referred herein were made with these techniques.

Table 1 below summarizes the charges achieved with the active polymers according to the present invention as well as the charge to mass ratio. It should be noted that Examples 5, 6, and 7 exhibited satisfactory charge to mass ratio but that the charge level was relatively low. It should be noted that 4% and 2% (Examples 5 and 6 respectively) of active polymers acording to the present invention provided substantially only the same charge level as the anodized aluminum.

TABLE I

| EXAMPLES | ACTIVE SUBSTRATES | M/A (mg/cm$^2$) | Q/M (μC/g) |
|---|---|---|---|
| 1. | Poly 2 vinyl pyridine (P2VP) | 1.00 | 14.3 |
| 2. | P2VP + 10% Ketjenblack | 0.93 | 13.1 |
| 3. | Copolymer 70% styrene/30% 4 vinyl pyridine | 1.04 | 12.8 |
| 4. | Copolymer 90% DMAEMA/10% hexafluoroisopropylmethacrylate | 0.84 | 13.4 |
| 5. | Terpolymer 4% 4-vinyl pyridine/96% (styrene/butylmethyacrylate) in a weight ratio of 65% to 35% | 0.72 | 10.3 |
| 6. | Terpolymer 2% 4 vinyl pyridine/98% (styrene/butylmethacrylate) in a weight ratio of 65% to 35% | 0.72 | 8.9 |
| 7. | Anodized Aluminum | 0.74 | 7.9 |

Examples 8 and 9 in Table II indicate the effect that relative humidity has on both the charge and the charge to mass ratio and shows the superiority of poly(2-vinylpyridine) over the previously used anodized aluminum. As may be observed the anodized aluminum showed a very large variation with humidity at much lower charge to mass levels in comparison to the poly(2-vinylpyridine).

TABLE II

Effect of Relative Humidity

| EXAMPLES | ACTIVE SUBSTRATES | % RH at 72° F. | M/A (mg/cm$^2$) | Q/M (μC/g) |
|---|---|---|---|---|
| 8. | Poly 2 vinylpyridine + 10% Ketjenblack | 35% | 0.93 | 13.1 |
| | | 65% | 0.93 | 10.0 |
| 9. | Anodized Aluminum | 35% | 0.74 | 7.9 |
| | | 65% | 0.56 | 4.9 |

Figure 3:
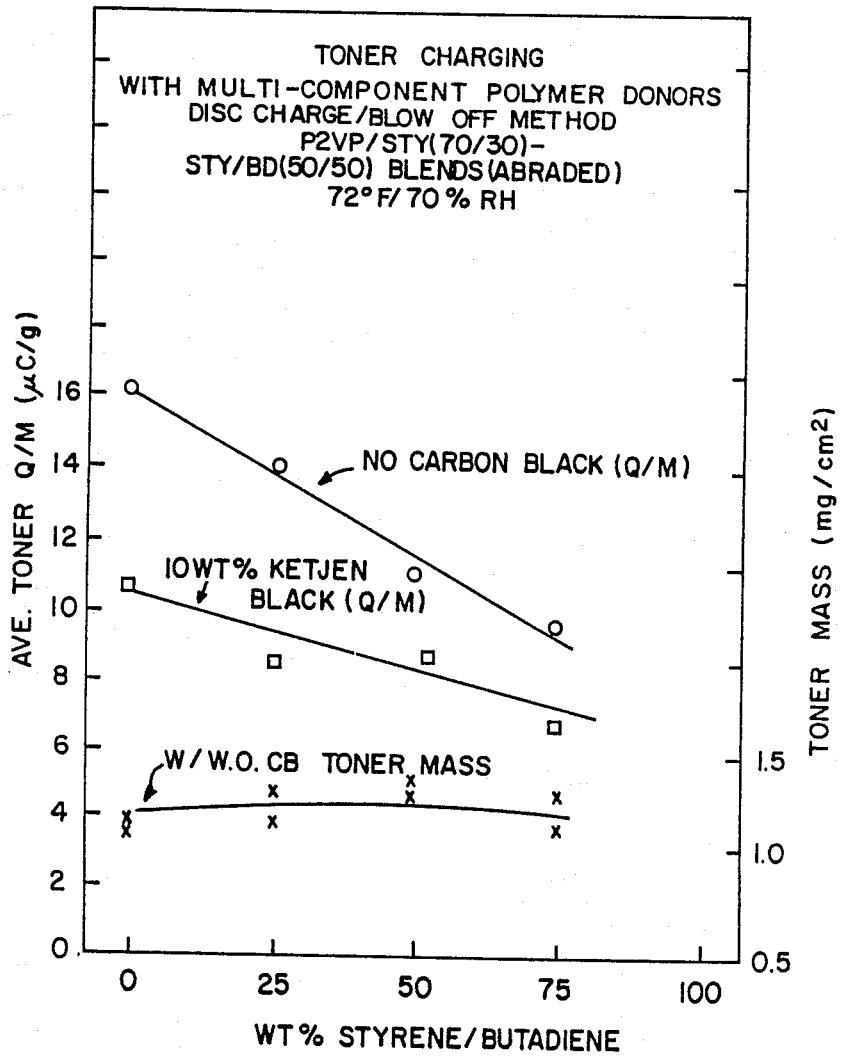
FIGS. 3 and 4 are graphical representations of toner charging levels and rates achieved with donor members according to the present invention.

FIG. 3 shows the effect of varying amounts of relatively tribo inert polymer material (50/50 styrene/butadine copolymer) on the charging characteristics of the active copolymer 70/30 P2VP/styrene when physically blended therewith. Surprisingly large Q/M ratios in a range most suitble for xerographic development i.e., 8 μC/g were obtained with a relatively small quantity of the active charging polymer.

Furthermore, the use of a conductive carbon black additive (Ketjenblack) generally required to permit charge relaxations of the roll after development, decrease the Q/M ratio only modestly and has little effect on deposited mass.

These results show that blends containing large amounts of elastomeric materials such as 50/50 styrene/butadiene copolymer can be rendered sufficiently tribo active to permit the fabrication of compliant films and molded compliant donor rolls for touch down development. The almost horizontal line at the bottom indicates that the carbon black has substantially no effect on the toner mass deposited on the disc.

Examples 10 through 17 below in Table III show that the charging rate of polymer blends decreases somewhat with increased concentrations of the elastomeric component, i.e., one vs two charging disc revolutions. But, essential charge equilibrium is achieved within two passes of the charging disc and more rapidly from the three passes assumed to simulate actual doner operation in a copying device.

The charge substrates were comprised of a physical blend of a copolymer of poly 2-vinylpyridine/styrene at the recited 70/30 weight ratios blended with a styrene butadiene latex 50/50 weight ratio (PLIOLITE) available from Goodyear Tire and Rubber Company at the recited weight ratio.

TABLE III

| EXAMPLES | DONOR | DISC REV. | M/A (mg/cm$^2$) | Q/A (fC/cm$^2$) | Q/M (μC/g) |
|---|---|---|---|---|---|
| 10. | P2VP/STY(70/30) Blended with PLIOLITE 75/25 BLEND | 1 | 0.78 | 4.3 | 13.0 |
| 11. | | 1 | 0.78 | 4.5 | 13.6 |
| 12. | | 2 | 0.93 | 4.6 | 11.8 |
| 13. | | 2 | 1.02 | 6.2 | 14.2 |
| 14. | P2VP/STY(70/30) PLIOLITE 50/50 BLEND | 1 | 0.79 | 2.9 | 8.7 |
| 15. | | 1 | 0.91 | 3.3 | 8.5 |
| 16. | | 2 | 0.81 | 4.4 | 12.7 |
| 17. | | 2 | 0.81 | 4.2 | 11.9 |

Figure 4:
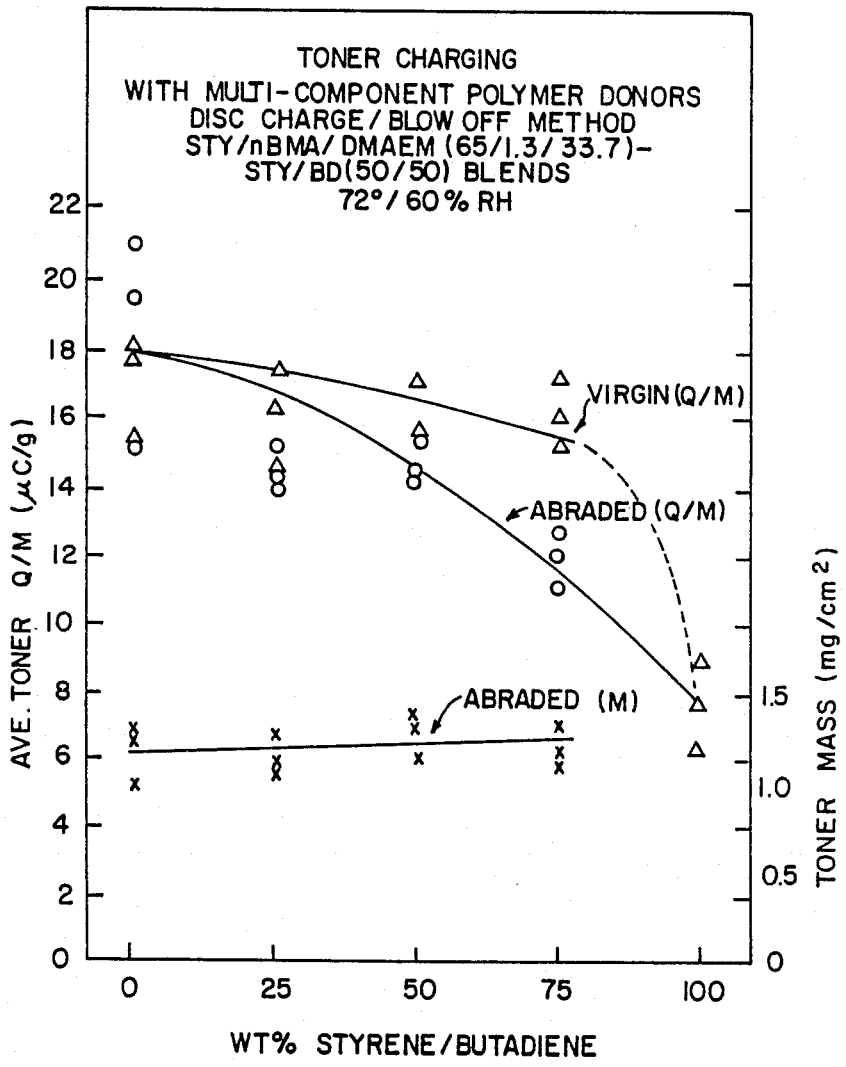

FIG. 4 is a graphical representation of other embodiments according to the present invention of toner charging with multiple component polymer donors where a terpolymer of styrene, n-butylmethacrylate and dimethylaminoethylmethacrylate in a weight ratio of 65/1.3/33.7 is blended in a weight ratio 50/50 with a styrene butadiene latex (weight ratio 50/50). The abraded samples are obtained by lightly rubbing the virgin sample surface with fine crocus cloth. This treatment simulates long term surface abrasion such as may be encountered in copier applications. Although some loss of tribo activity is found, rapid charging and a relatively high Q/M ratio are still observed with as little as 25% of the active component. It should be noted however, that the blends containing the active polymer achieve the indicated charge at 3 revolutions of the charging disc while the charge indicated at equilibrium for the 100% styrene butadiene copolymer were achieved only within excess of 20 revolutions of the charging disc.

According to the present invention a novel apparatus and method for developing an electrostatic latent image is provided. In particular a charging donor member having improved charging characteristics in both rate of charging and charge level over those previously described has been provided. Furthermore, the active polymers may be blended or polymerized with other materials to provide a compliant donor member such as a roll. In addition the development method has the beauty of simplicity, and economy of cost. Donor members having surfaces comprising an active polymer having a basic amine moiety as described herein have successfully charged toner particles and developed the electrostatic latent image in an apparatus generally depicted in FIGS. 1 and 2.

The disclosures of the patents and patent applications referred to herein are hereby specifically and totally incorporated herein by reference.

While the invention has been described with reference to specific embodiments thereof it will be apparent to those skilled in the art that many alternatives, modifications and variations may be made. Accordingly it is intended to embrace all such alternatives and modifications as may fall within the spirit and scope of the appended claims.

What is claimed is:

1. The method of developing a positively charged electrostatic latent image on an imaging surface comprising the steps of;

providing a reservoir for holding toner, at least partially filling said reservoir with toner, positioning a moveable donor member such that a portion of its surface extends into said reservoir of toner, and;

providing a webbed screen in contacting relationship with an area of the surface of said donor member that extends into said reservoir, moving said donor member relative to said screen so that toner pressing through said webbed screen is friction charged and a smooth toner layer is applied to said donor member, said donor member having a surface comprising an active polymer having a basic amine moiety whereby when said donor member is moved, the roll contact between said toner, screen and donor member produces negatively charged toner particles; and developing said electrostatic latent image with said charged toner particles.

2. The method of claim 1, wherein said donor member surface also includes an amount of a finely divided conductive filler sufficient to provide cyclic discharge.

3. The method of claim 1, wherein said donor member is a roll and said active polymer is blended with a compliant rubber material said active polymer being present in an amount to enhance negative charging of said toner.

4. The method of claim 1, wherein said donor member is a roll and said active polymer is copolymerized with another monomer to form a compliant roll.

5. The method of claim 1, wherein said active polymer having a basic amine moiety is selected from the group consisting of poly(2-vinylpyridine), poly(4-vinylpyridine), polyvinylpryolidone, poly(dimethylaminoethylmethacrylate).

6. The method of claim 1, wherein said active polymer is copolymerized with a material selected from the group consisting of styrene, acrylates and butadiene said active polymer being present in an amount greater than about 30% by weight of the copolymer.

7. The method of claim 6, wherein said copolymer is blended with a styrene/butadiene latex.

8. The method of claim 9, wherein said toner comprises a minor amount of submicroscopic formed silica.

9. Electrostatographic development apparatus for development of an electrostatic latent image on an imaging surface with negatively charged toner comprising;

a charging donor member closely spaced from said imaging surface and adapted to apply toner to said imaging surface, housing means adapted to be filled with toner and positioned adjacent said donor member for loading toner onto said donor member for electrostatic transfer to said imaging surface, and;

webbed screen means located in said housing means and adapted to contact said donor member so that the toner loaded from said housing means onto said donor member passes through said webbed screen means in order to make rubbing contact with and form a dense uniform layer of toner on said donor member, said donor member having a surface comprising an active polymer having a basic amine moiety whereby the rubbing contact between said toner, screen means and said donor member provides negatively charged toner particles.

10. The apparatus of claim 9, wherein said donor member surface also includes an amount of finely divided conductive filler sufficient to provide cyclic discharge.

11. The apparatus of claim 9, wherein said donor member is a roll and said active polymer is blended with a compliant rubber material, said active polymer being present in an amount to enhance negative charging of said toner.

12. The apparatus of claim 9, wherein said donor member is a roll and said active polymer is copolymerized with another monomer to form a compliant roll.

13. The apparatus of claim 9, wherein said active polymer having a basic amine moiety is selected from the group consisting of poly(2-vinylpyridine), poly(4-vinylpyridine), poly vinylpyrolidone, poly(dimethylaminoethylmethacrylate).

14. The apparatus of claim 13, wherein said active polymer is copolymerized with a material selected from the group consisting of styrene, acrylates and butadiene said active polymer being present in an amount greater than about 30% by weight of the copolymer.

15. The apparatus of claim 14, wherein said copolymer is blended with a styrene/butadiene latex.

16. The apparatus of claim 13, wherein said active polymer is blended with a material selected from the group consisting of styrene, acrylates and butadiene and mixtures thereof.

17. The apparatus of claim 9, wherein said donor member during the charging operation provides a charge on said toner particles of from about 10 to about 20 microcoulombs per gram.

18. The apparatus of claim 9, wherein said webbed screen is stationary during development and said donor member is a cyclindrical roll rotatably mounted in said housing whereby when said roll is rotated the toner particles are charged.

* * * * *